US005103582A

United States Patent [19]

Farmer

[11] Patent Number: 5,103,582

[45] Date of Patent: Apr. 14, 1992

[54] DISPLAY SIGN

[76] Inventor: Kenneth R. Farmer, 2397 Church Rd., Smyrna, Ga. 30080

[21] Appl. No.: 638,805

[22] Filed: Jan. 8, 1991

[51] Int. Cl.[5] ..... G09F 15/00

[52] U.S. Cl. ..... 40/606; 40/607; 40/617

[58] Field of Search ..... 40/606, 607, 617; 248/156, 251, 215, 218.4, 304; 52/38, 155, 153, 158, 166, 292, 721, 703

[56] References Cited

U.S. PATENT DOCUMENTS

| | | | |
|---|---|---|---|
| 514,569 | 2/1884 | Sigler | 52/166 |
| 1,631,811 | 6/1927 | Guenther . | |
| 2,628,371 | 2/1953 | Null . | |
| 2,926,824 | 3/1960 | St. Clair | 248/304 X |
| 2,942,831 | 6/1960 | Adams et al. | 248/307 |
| 3,850,401 | 11/1974 | Snediker | 40/606 X |
| 3,889,409 | 6/1975 | Thomas | 40/606 X |
| 4,173,086 | 11/1979 | Hempfling | 40/607 |
| 4,326,352 | 4/1982 | Barth | 40/607 |
| 4,658,527 | 4/1987 | Pingel | 40/606 |
| 4,760,801 | 8/1988 | Campbell . | |
| 4,790,092 | 12/1988 | Farmer | 40/606 X |
| 4,846,430 | 7/1989 | Ke | 248/215 |
| 4,880,195 | 11/1989 | Lepley | 40/607 X |
| 4,894,937 | 1/1990 | Davis | 40/606 |

FOREIGN PATENT DOCUMENTS

| | | |
|---|---|---|
| 800426 | 10/1950 | Fed. Rep. of Germany . |
| 1147375 | 11/1957 | France . |
| 269750 | 11/1950 | Switzerland . |

*Primary Examiner*—Kenneth J. Dorner
*Assistant Examiner*—Milton Nelson, Jr.
*Attorney, Agent, or Firm*—Wigman & Cohen

[57] ABSTRACT

A display sign in which a panel is supported in cantilever fashion is disclosed. The display sign generally comprises a corrugated panel which may be mounted to a vertical post by a pair of rods which pass through the corrugation channels of the panel and extend through holes in the vertical post. The rods are shaped in a manner to engage the corrugation channels of the panel so as to prevent horizontal sliding or pivoting of the panel relative to the rods.

13 Claims, 2 Drawing Sheets

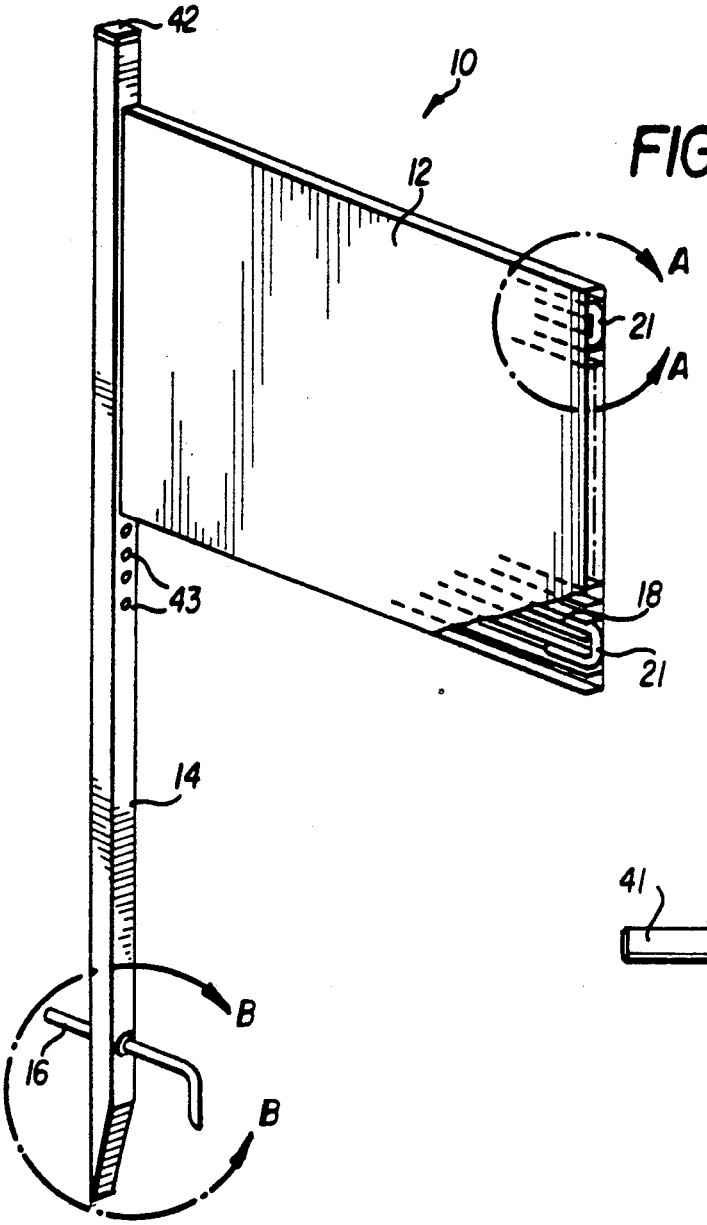
FIG. 1
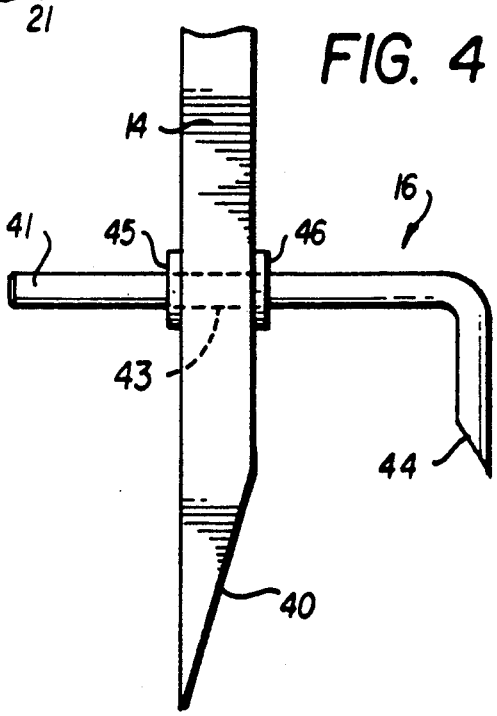
FIG. 4
FIG. 5
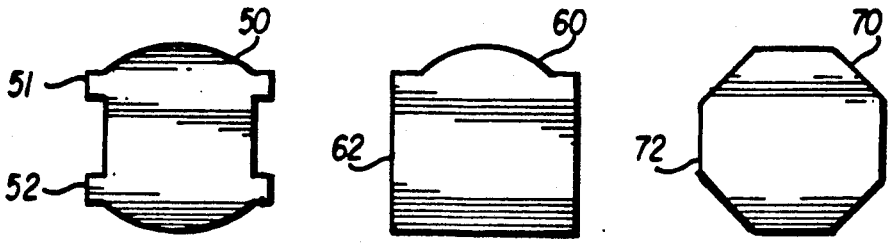

DISPLAY SIGN

FIELD OF THE INVENTION

The present invention relates to a display sign and more particularly to a display sign in which a display panel is supported in cantilever fashion by a vertical post by a means which allows quick and easy attachment and removal of the sign from the post.

DESCRIPTION OF THE PRIOR ART

In the real estate industry, as well as in political campaigns, it is usually necessary to display signs on a temporary basis. These signs must by sturdy and attractive yet at the same time lightweight and easy to assemble and install. Ease of assembly is especially important since the signs are frequently placed by persons with little installation experience. Another important criterion, especially for political campaigns, is that the materials employed by inexpensive.

Attempts to meet the above criterion include several display signs which utilize a corrugated material for the display panel. The advantages of employing a corrugated material for the panel are its lightweight but sturdy nature as well as the fact that the channels formed by the corrugations may be utilized for mounting purposes.

One example of a sign with corrugated panel is disclosed in U.S. Pat. No. 4,894,937 to Davis which comprises a corrugated panel and a two-legged stake which engages the corrugation channels. One disadvantage of this device is that the display panel can be easily dislodged from the legs of the stake by winds, children, etc. Moreover, the Davis sign employs a multiple-legged stake design rather than the more expensive-looking and elegant cantilevered sign which employs a single stake.

U.S. Pat. No. 4,658,527 to Pingel also discloses a sign made of corrugated material. A pair of separate vertical posts with horizontal pivot pins mounted thereon are inserted into the channels of a corrugated sign panel to support the same. There are several disadvantages of this device. First, no means are provided to prevent the sign panel from sliding off one or both of the pins if the vertical posts are pushed away from each other. Secondly, the sign panel can easily pivot about its horizontal axis making it difficult to read in windy conditions. Thirdly, the sign requires two posts which, as discussed above, is undesirable from an aesthetic standpoint.

SUMMARY OF THE INVENTION

In view of the foregoing, it should be apparent that a need still exists in the art for a display sign which is lightweight, yet stable and secure, attractive, easy to install, and which ovecomes the aforesaid disadvantages of the prior art.

Accordingly, it is a primary object of this invention to provide a display sign having a single vertical post, thereby permitting easy storage and installation, and being lighter in which than a sign with a pair of vertical posts.

Another object of this invention is to provide a display sign frame having a minimum number of parts.

Another object of this invention is to provide a display sign which ca easily accommodate sign panels of various heights, widths, and shapes.

Another object of this invention is to provide a sign with means to prevent the panel from being easily pulled away from the supporting post or pivoted relative to the post.

Another object of this invention is to provide a display sign which meets all of the aforementioned objects and yet which is attractive and presents the favorable impression of the more expensive-looking and elegant cantilevered sign arrangement.

Another object of this invention is to provide a display sign which may be easily driven into the ground by means of a hammer or similar tool.

Briefly described, the aforementioned objects are accomplished according to the invention by providing a sign panel of rectangular or other polygonal shape which is constructed of corrugated plastic material. The sign panel is mounted to a vertical post in a cantilever fashion, by means of a pair of rods which pass through the corrugations of the panel and extend through holes in the vertical post. The ends of the rods which extend through the post are threaded allowing them to be secured to the post by means of wing nuts. The opposite ends of the rods are shaped in a manner to engage the horizontal sliding or pivoting of the panel relative to the rods. The preferred shape of the rod ends is a hook-like shape formed by bending the end of the rod at two right angles so that the free end of the rod is directed toward the post and is parallel to that portion of the rod passing through the sign panel. Shaping the rods in such a manner eliminates the need to thread both ends of the rod and use an additional pair of wing nuts or cap nuts.

A horizontal L-shaped stabilizer bar is removably mounted near the base of the vertical post to provide a sturdy reinforcement to the upright post when driven into the ground. The stabilizer bar also prevents the post and sign panel from rotating in high winds and from tilting from the vertical.

With the foregoing and other objects, advantages, and features of the invention that will become hereinafter apparent, the nature of the invention may be more clearly understood by reference to the following detailed description of the invention, the appended claims and to the several views illustrated in the drawings.

BRIEF DESCRIPTION OF THE DRAWINGS

FIG. 1 is a perspective view of the display sign of the present invention;

FIG. 4 is an enlarged side elevation view of detail B of FIG. 1 illustrating the stabilizer bar; and FIG. 5 is an elevation view illustrating alternate embodiments of the shape of the sign panel.

DETAILED DESCRIPTION OF THE INVENTION

Figure 2:
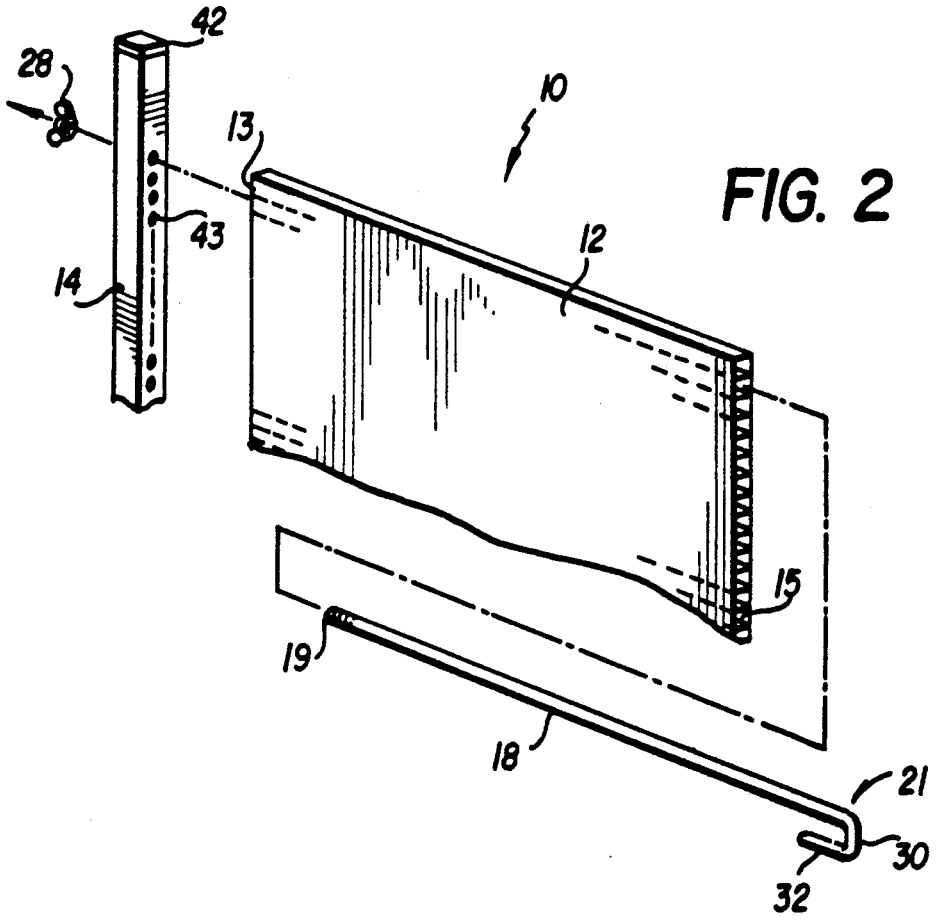
FIG. 2 is an exploded perspective view of the upper portion of the display sign of the present invention.

Referring now in detail to the drawings wherein like parts are designated by like reference numerals throughout, there is illustrated in FIGS. 1 and 2 perspective views of the display sign designated generally by reference numeral 10. Display sign 10 generally comprises a panel 12 supported in cantilevered fashion to a vertical post 14 by a pair of connecting rods 18. Connecting rods 18 are provided with an integrally formed sign retention hook 21 to prevent panel 12 from sliding off and pivoting about the rods. Stabilizer bar 16 is provided for installing the sign and for increased stabilization when the sign is installed.

Sign panel 12 is preferably made of an extruded corrugated polypropylene carton material. Exemplary of the types of material which may be employed for the sign panel is the Coroplast TM brand of corrugated polypropylene manufactured by the Innopac Company of Irving, Texas and Granby, Quebec, Canada. Alternatively, the sign may be constructed of corrugated paperboard or similar material provided with a plurality of corrugations or channels and treated for adverse weather conditions by a plastic coating or the like. If a corrugated polypropylene is employed, as in the preferred embodiment, the material is preferably chemically treated to allow printing inks to be retained on the surface. This allows application of advertisements or similar indicia.

Figure 3:
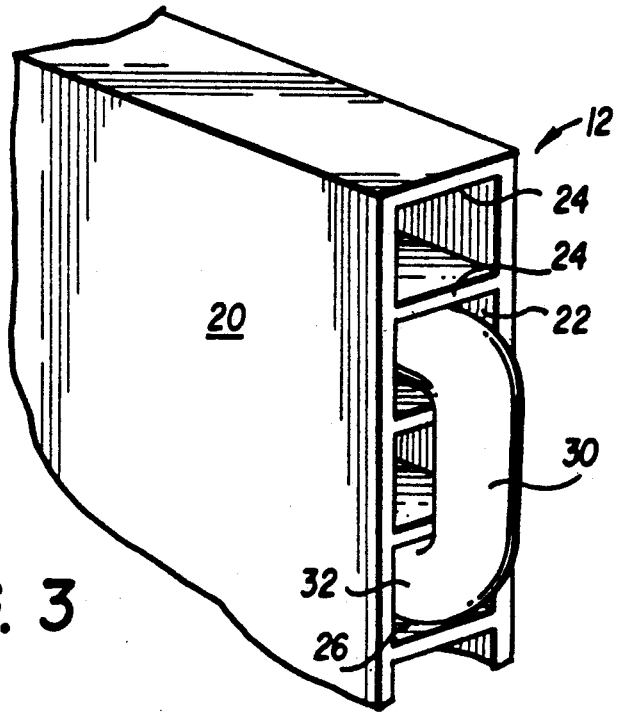
FIG. 3 is an enlarged perspective view of detail A of FIG. 1 illustrating the sign retention hook in engagement with the display panel.

Referring to the detail of FIG. 3, panel 12 comprises a pair of parallel planar members 20, 22 spaced by a plurality of vertical spaced, transversely extending web members 24 integrally formed with the planar members 20, 22. This arrangement of members 20,22 and 24 forms a plurality of rectangular-shaped channels 26.

Sign panel 12 is mounted along its inner edge 13 to vertical post 14. This arrangement provides a cantilevered sign appearance which is believed to be more aesthetically pleasing and expensive looking. In order to secure the panel to the post without utilizing brackets and the like which grip exterior portions of the sign, a pair of rods 18 are employed. As best seen in FIG. 2, one end of each rod 18 is provided with threads 19 for threadably receiving wing-nut 28 or the like. The opposite end of each rod 18 is provided with an integrally formed L-shaped hook 21 for engaging and retaining the sign panel. Retention hook 21 specifically comprises a vertical member 30 and horizontal member 32 formed by bending the end of the rod at two right angles as shown.

Referring now to FIGS. 1 and 4, vertical post 14, preferably formed of steel tubing having a square cross-section, is provided at its lower end with a sharpened point 40 to permit the post to be driven into the ground. An end cap 42, constructed of metal or plastic may be inserted in the upper end opening of vertical post 14. In order to provide means to install the sign and to stabilize the vertical post in the ground, a stabilizer bar 16 is included. Bar 16 is preferably formed of steel rod bent at a right angle adjacent one end to form an L-shaped bar as illustrated in FIG. 4. The bent end 41 of the bar terminates in a sharpened point 44. The opposite end of the bar is removably inserted into an aperture 43 provided in post 14. Bar 16 is retained in the aperture by a pair of resilient rings, such as rubber O-rings 45, 46 which circumscribe and frictionally engage the bar on opposite sides of the post. Because the outside diameter of O-rings 45, 46 is greater than that of the aperture 43 provided in post 14, the bar 16 is prevented from moving horizontally relative to the post. It will be appreciated that this arrangement can be readily assembled and disassembled by sliding O-ring 45 onto and off the end 41 of bar 16.

To assembly and erect display sign 10, vertical post 14 is placed in a desirable location and driven into the ground by means of a hammer or similar tool. The pointed end 44 of bar 16 penetrates the ground and provides further stabilization against rotation and tilting of the sign post 14.

Two or more rods 18 are inserted into channels 26 of panel 12 in spaced relation, preferably so that one rod is near the top of the panel and one rod is near the bottom of the panel. Rods 18 are passed through the entire length of the channels 26 until hook 21 engages the outer edge 15 of the display panel. In this position, illustrated in FIG. 3, vertical member 30 is positioned adjacent webbed members 24 parallel to and intermediate planar members 20, 22. Horizontal member 32 is slidably received in one of the channels 26. The threaded portion 19 of rod 18 extending beyond edge 13 is inserted in one of a plurality of apertures 43 in post 14. A wing nut 28 is threaded to end 19 of rod 18 and tightened by hand. In this position, sign panel 12 is securely retained to the vertical post 14 by the wing nuts 28 on one side, and by the L-shaped hooks 21 on the opposite side.

FIG. 5 illustrates several possible shapes of signs that may be mounted with the present invention. If two rods 18 are used it is only necessary that two points on one side of the sign engage the post. For sign 50 the post is engaged at points 51, 52; for sign 60 the post is engaged along vertical side 62; and for octagonal sign 70 the post is engaged along vertical side 72. Those skilled in the art will appreciate that many other shapes of signs may be mounted according to the teachings of the present invention.

Although certain presently preferred embodiments of the invention have been described herein, it will be apparent to those skilled in the art to which the invention pertains that variations and modifications of the described embodiment may be made without departing from the spirit and scope of the invention. Accordingly, it is intended that the invention be limited only tot he extent required by the appended claims and the applicable rules of law.

What is claimed is:

1. A display sign comprising:

a panel adapted to receive a display, said panel constructed of a corrugated material and having outer edges, said corrugated material forming channels extending through said panel;

a post;

at least one rod means extending completely through a first one of said channels for securing said panel to said post, said rod means having two ends, said rod means having a retention means at one end thereof for retaining said panel on said rod means and means on the other end of said rod means for fastening the rod means to the post, said retention means including a bent end position of said rod means extending transversely of said rod means outwardly of an outer edge of the panel whereby the panel is retained between said portion and the post.

2. The display sign of claim 1, wherein said retention means comprises a hook means on said one end for engaging in a second one of said channels.

3. The display sign of claim 2, wherein said fastening means comprises a thread on said other end and a threaded fastener for threadably receiving the threaded end of the rod.

4. The display sign of claim 1, wherein said retention means comprises an L-shaped hook integrally formed at said one end of the rod, at least a portion of said hook engaging in a second one of said channels.

5. The display sign of claim 4, including a stabilizer bar extending generally transversely through an aperture in said post, said bar being removably retained on said post by a pair of generally resilient rings circumscribing said bar on opposite sides of said post.

6. The display sign of claim 5, wherein said resilient rings are O-rings.

7. The display sign of claim 5, wherein said bar comprises two portions in an L-shape, a first portion extending through said post and a second portion extending parallel to said post, said second portion being pointed to facilitate penetration into the supporting surface.

8. The display sign of claim 7, wherein one end of said post is pointed to facilitate penetration into the supporting surface.

9. The display sign of claim 1, including at least two of said rod means for securing said panel to said post in cantilever fashion.

10. The display sign of claim 1, wherein said panel is octagonally shaped.

11. The display sign of claim 3, wherein said threaded fastener is a wing nut.

12. A display sign comprising:

a vertical post having an upper portion and a lower portion, the upper portion adapted to support a display panel made of a corrugated material and having a plurality of channels, the lower portion adapted to be inserted into the ground, said lower portion having an aperture extending transversely therethrough;

a pair of rod members each extending through a respective channel of said panel, each rod member having two ends, one end of each rod member being secured to said post, the other end of each rod member having an L-shaped hook engageable in a channel of said panel spaced from the channel through which the respective rod member extends;

a generally L-shaped bar member having a first portion adapted to be received in said aperture of the lower portion of said post, and a second portion generally perpendicular to said first portion, said second portion terminating in a pointed end; and a pair of generally elastic rings for retaining said L-shaped bar member on said post, said rings circumscribing and frictionally engaging said L-shaped bar member on opposite sides of said post.

13. The display sign of claim 1 including only one of said posts, whereby said display sign is cantilevered from said one post.

* * * * *